US006243041B1

(12) United States Patent
Mischenko et al.

(10) Patent No.: US 6,243,041 B1
(45) Date of Patent: Jun. 5, 2001

(54) ANTENNA INDEXING AND RETAINING MECHANISM

(75) Inventors: Nicholas Mischenko, Mt. Prospect; Keith Gronczewski, Des Plaines, both of IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/557,235

(22) Filed: Apr. 24, 2000

(51) Int. Cl.[7] ..... H01Q 1/24
(52) U.S. Cl. ..... 343/702; 343/882
(58) Field of Search ..... 343/702, 906, 343/878, 882; 439/916

(56) References Cited

U.S. PATENT DOCUMENTS

| | | | | |
|---|---|---|---|---|
| 4,074,271 | | 2/1978 | Sakuma | 343/882 |
| 5,218,369 | | 6/1993 | Jennings | 343/702 |
| 5,271,684 | | 12/1993 | Phillips | 403/106 |
| 5,276,454 | * | 1/1994 | Gonzalez et al. | 343/702 |
| 5,559,522 | | 9/1996 | Seitz | 343/702 |
| 5,603,630 | | 2/1997 | Villain | 439/347 |
| 5,831,579 | * | 11/1998 | Rudisill | 343/702 |
| 5,886,673 | * | 3/1999 | Thomas | 343/882 |
| 6,166,695 | * | 12/2000 | Witczak et al. | 343/702 |

FOREIGN PATENT DOCUMENTS

| | | |
|---|---|---|
| 2195841A | 4/1988 | (GB) . |
| 5-327328 | 12/1993 | (JP) . |
| WO 98/47199A1 | 10/1998 | (WO) . |

* cited by examiner

*Primary Examiner*—Tan Ho
(74) *Attorney, Agent, or Firm*—Lalita P. Williams; Hisashi D. Watanabe

(57) ABSTRACT

An antenna indexing and retaining mechanism (100) for coupling an antenna stem (117) to a transceiver (701) is provided. The mechanism (100) includes a plurality of plates disposed in a first plane (173) substantially perpendicular to an axis (174) of the antenna stem (117), a first plate (102) of the plurality of plates to engage a first antenna stem surface (144) of the antenna stem and a second plate (103) of the plurality of plates to engage a second antenna stem surface (145) of the antenna stem. The mechanism (100) also includes a release plate (106) having projections (124, 125) extending into the first plane (102), the projections (124, 125) causing the plurality of plates to be disengaged from the antenna stem (117) upon translation of the release plate (106).

20 Claims, 8 Drawing Sheets

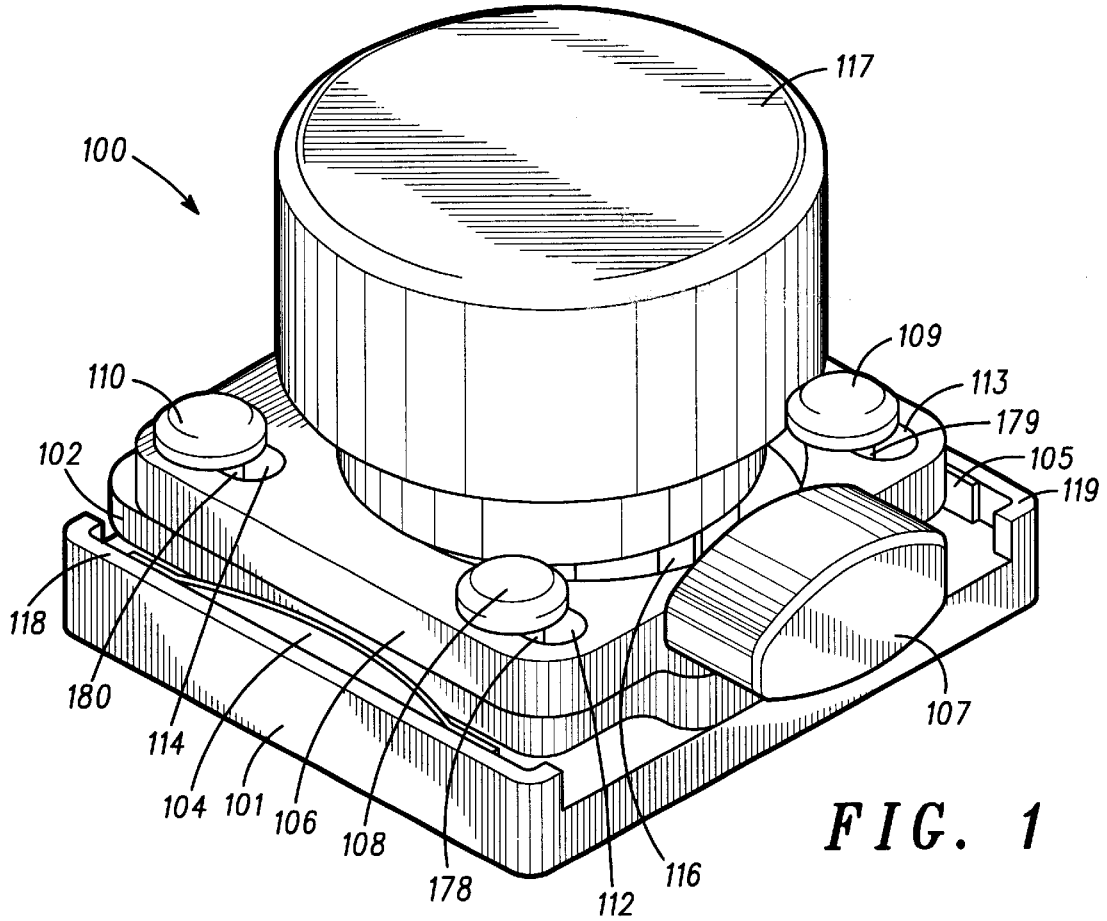
FIG. 1
FIG. 2
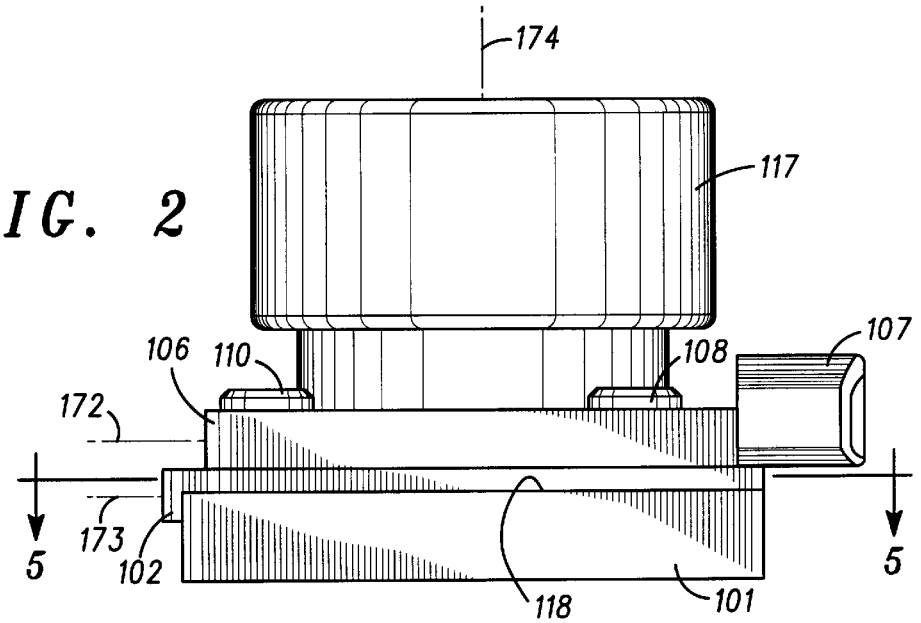

ANTENNA INDEXING AND RETAINING MECHANISM

FILED OF THE INVENTION

The present invention relates generally to techniques for providing a rotatable connection between an antenna assembly and a transceiver. Although the invention is subject to a wide range of applications, it is especially suited for use in a satellite radio communications system and will be particularly described in that context.

BACKGROUND OF THE INVENTION

A cellular radiotelephone system consists of a number of base stations and radiotelephone transceiver handsets. The user receives and places radiotelephone calls through the handset, which is in radio communication with one of the base stations.

A satellite radio communications system, such as the IRIDIUM® system, has a network of satellites in a low earth polar orbit, each satellite performing the same function as a base station. The satellites transmit and receive signals from a satellite subscriber unit (SSU) to form a radiotelephone system, allowing users to place radiotelephone calls from almost anywhere in the world to almost anywhere else in the world.

Unlike cellular systems, the satellites do not remain in the same place with respect to the surface of the earth. Since the satellite could be anywhere in the hemisphere above the user, the SSU's antenna needs to have a gain pattern that covers the hemisphere above the user. Thus, designers have developed an antenna with a hemispherical gain pattern.

In order for an SSU to communicate with any of the possible low earth orbit satellites, the SSU's antenna is to be oriented in a vertical position with respect to the ground. This orientation should be maintained regardless of whether the user is holding the SSU in his or her right or left hand.

U.S. Pat. No. 5,559,522 describes an antenna positioning apparatus capable of substantially vertical orientation of a radiotelephone antenna with respect to the ground. Although the antenna positioning system described can be useful in some radiotelephone configurations, it may not operate properly in all, such as configurations wherein the antenna does not include a wedge shaped mating surface. Thus, there is a need for an alternative apparatus that maintains the antenna in a vertical position with respect to the ground when an SSU is transmitting or receiving. Because signals transmitted between a satellite and an SSU have to travel farther distances than signals in a cellular system, there is an additional need for an apparatus that provides a robust electrical connection as the SSU's antenna is rotated to an active position with respect to the SSU's handset.

BRIEF DESCRIPTION OF THE DRAWINGS

FIG. 1 is a perspective view of an antenna indexing and retaining mechanism 100 in accordance with an embodiment of the invention.

FIG. 2 is an elevation view of an antenna indexing and retaining mechanism 100 in accordance with an embodiment of the invention.

DETAILED DESCRIPTION OF THE PREFERRED EMBODIMENT

Figure 3:
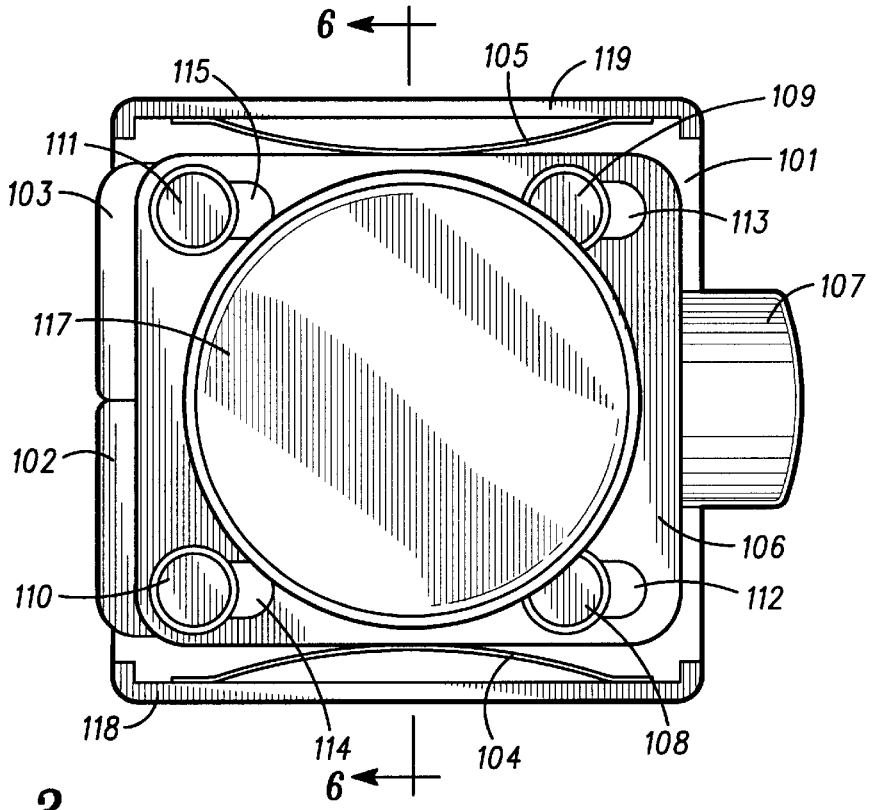
FIG. 3 is a top plan view of an antenna indexing and retaining mechanism 100 in accordance with an embodiment of the invention.

An antenna indexing and retaining mechanism is described. The antenna indexing and retaining mechanism is useful for coupling an antenna stem to a transceiver. The following detailed description is exemplary and explanatory only and is not restrictive of the invention as claimed. The accompanying drawings illustrate the preferred embodiment of the invention and together with the description serve to explain the principles of the invention.

FIG. 1 is a perspective view of an antenna indexing and retaining mechanism 100 in accordance with an embodiment of the invention. The mechanism 100 comprises a base plate 101 having a first side wall 118 and a second side wall 119. A plurality of plates, including a first plate 102 and a second plate 103 (FIG. 3), are disposed in a first plane 173 (FIG. 2) substantially parallel to the plane in which the base plate 101 lies. The first plane 173 is substantially perpendicular to an axis 174 of an antenna stem 117. A first spring 104, preferably a curved leaf spring, is disposed between the first side wall 118 of the base plate 101 and an exterior side of the first plate 102. A second spring 105, preferably a curved leaf spring, is disposed between the second side wall 119 of base plate 101 and an exterior side of the second plate 103 (FIG. 3).

A release plate 106 is disposed in a second plane 172 (FIG. 2) substantially parallel to the first plane 173. A button 107 is coupled to a front side of the release plate 106. A plurality of pins 178, 179, 180, and 181 (FIG. 5) have enlarged heads 108, 109, 110, and 111 (FIG. 3), respectively. The plurality of pins 178, 179, 180, and 181 pass through a plurality of holes 112, 113, 114, and 115 (FIG. 3), respectively, defined in the release plate 106. An aperture 116 is defined in the release plate 106 through which an antenna stem 117 may pass. The plurality of plates engage and retain the antenna stem 117.

Figure 5:
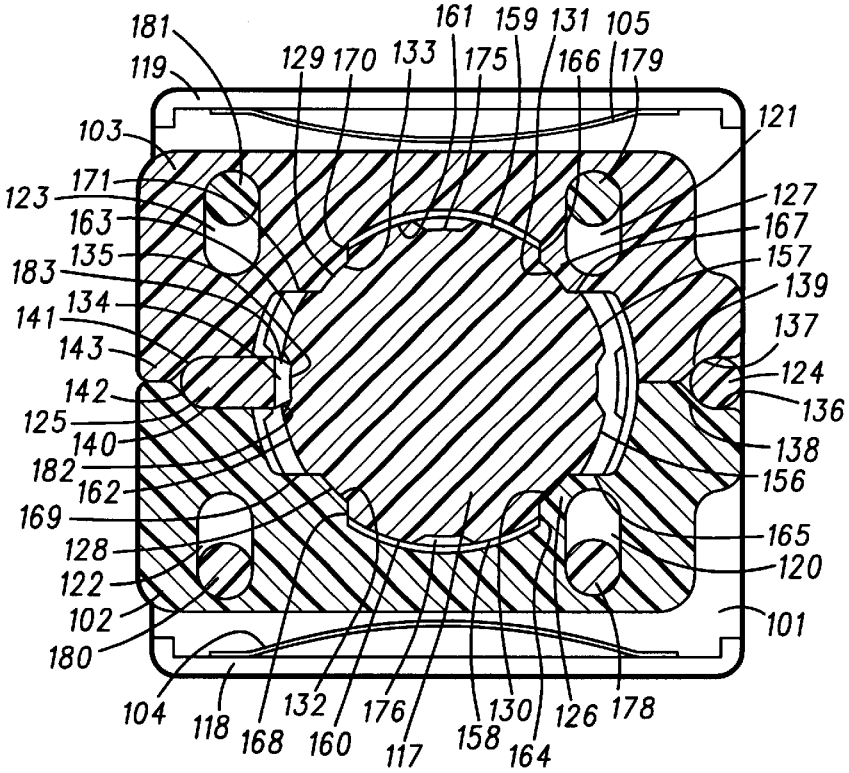
FIG. 5 is cross-sectional view of an antenna indexing and retaining mechanism 100 in accordance with an embodiment of the invention.

FIG. 2 is an elevation view of an antenna indexing and retaining mechanism 100 in accordance with an embodiment of the invention. A first plate 102 lies in a first plane 173 above base plate 101. The first plate 102 (along with a second plate 103) is at least partially contained between side wall 118 and side wall 119 (FIG. 1). The release late 106 lies in a second plane 172 above the first plate 102. The enlarged heads 108, 109 (FIG. 3), 110, and 111 (FIG. 3) of the pins 178, 179, 180, and 181 (FIG. 5) are above the release plate 106 and retain the release plate and the plurality of plates including first plate 102. The pins have axes substantially perpendicular to the first plane 173 and the second plane 172. An antenna stem 117 passes through the release plate 106 and is engaged by the first plate 102. The axis 174 of the antenna stem 117 is substantially perpendicular to the first plane 173 and the second plane 172. Thus, the axis 174 of the antenna stem 117 is substantially parallel to the axes of the pins 178, 179, 180, and 181. A sectional view taken along line 5—5, illustrated in FIG. 5, is taken looking downward through a plane parallel to and just above the first plane 173.

FIG. 3 is a top plan view of an antenna indexing and retaining mechanism 100 in accordance with an embodiment of the invention. A first spring 104 is disposed between a first side wall 118 of base plate 101 and an exterior side of a first plate 102. A second spring 105 is disposed between a second side wall 119 of base plate 101 and an exterior side of a second plate 103. An interior side of the first plate 102 is adjacent to an interior side of the second plate 103. The first plate 102 is held against the second plate 103 by the force of the first spring 104 and the second spring 105. The first plate 102 and the second plate 103 retain the antenna stem 117.

Enlarged heads 108, 109, 110, and 111 of pins 178, 179, 180, and 181, respectively, retain a release plate 106. The release plate 106 defines holes 112, 113, 114, and 115 through which pins 178, 179, 180, and 181, respectively, pass. The holes 112, 113, 114, and 115 are elongated in a direction toward button 107 to allow translation of the release plate 106 relative to the pins 178, 179, 180, and 181 when the button 107 is depressed. The aperture 116 defined in the release plate 106, through which the antenna stem 117 may pass, is also elongated by a distance similar to that of holes 112, 113, 114, and 115 to allow translation of the release plate 106 without interference from the antenna stem 117.

Figure 4:
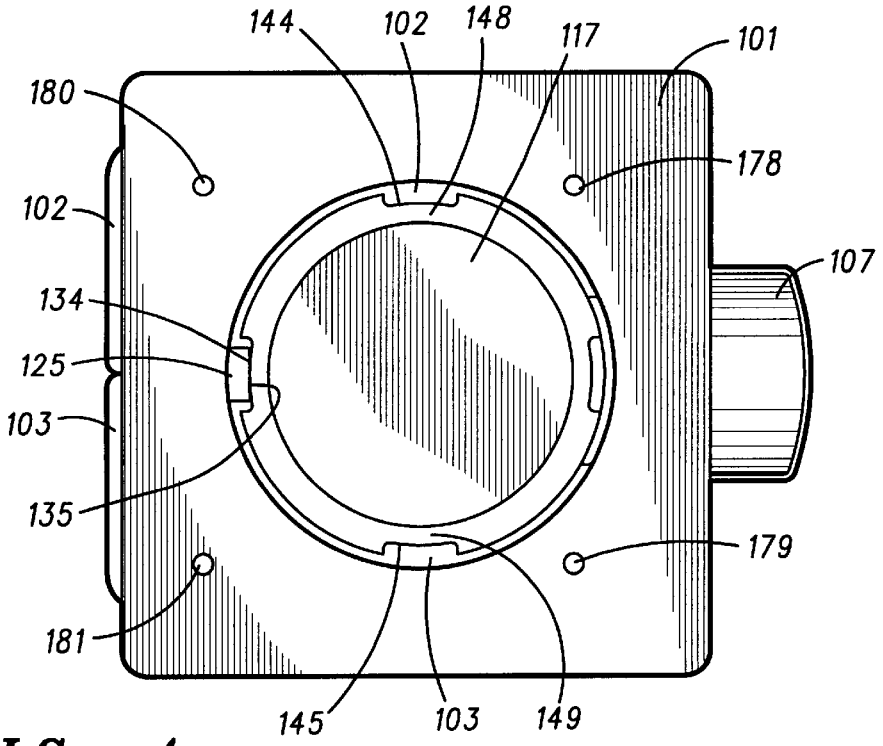
FIG. 4 is a bottom plan view of an antenna indexing and retaining mechanism 100 in accordance with an embodiment of the invention.

FIG. 4 is a bottom plan view of an antenna indexing and retaining mechanism 100 in accordance with an embodiment of the invention. Pins 178 and 180 pass through a first plate 102 and are secured in a base plate 101. Pins 179 and 181 pass through a second plate 103 and are secured in the base plate 101. An antenna stem 117 is engaged and retained by the first plate 102 and the second plate 103. A chamfered edge 148, 149 of the antenna stem 117 allows engagement with the first plate 102 and the second plate 103 without the need to depress button 107. The first plate 102 engages a first antenna stem surface 144 of the antenna stem 117. The second plate 103 engages a second antenna stem surface 145 of the antenna stem 117. A projection 125 of a release plate 106 extends into the first plane 173 of the first plate 102 and the second plate 103. The projection 125 includes a cam 134 that engages a portion 135 of a cam following surface 175 (FIG. 5) of the antenna stem 117.

FIG. 5 is cross-sectional view of an antenna indexing and retaining mechanism 100 in accordance with an embodiment of the invention. A base plate 101 includes a first side wall 118 and a second side wall 119. A first plate 102 and a second plate 103 are disposed between the first side wall 118 and the second side wall 119. A first spring 104 is disposed between the first side wall 118 and the first plate 102. A second spring 105 is disposed between the second side wall 119 and the second plate 103. The first spring 104 applies a force on the first plate 102 toward the second plate 103. The second spring 105 applies a force on the second plate 103 toward the first plate 102. Thus, the first plate 102 and the second plate 103 are held together under the influence of the first spring 104 and the second spring 105.

Pins 178 and 180 pass through holes 120 and 122 defined in the first plate 102. Pins 179 and 181 pass through holes 121 and 123 defined in the second plate 103. The pins 178, 179, 180, and 181 maintain registration of the plurality of plates and the release plate 106. The holes 120 and 122 are elongated in a direction toward the second plate 103, and the holes 121 and 123 are elongated in a direction toward the first plate 102 to allow translation of the first plate 102 toward the first side wall 118 against the force of the first spring 104 and the second plate 103 toward the second side wall 119 against the force of the second spring 105. Holes 120, 121, 122, and 123 have a major axis (along the direction of elongation) that is substantially perpendicular to the major axis (along the direction of elongation) of holes 112, 113, 114, and 115 (FIG. 3). This provides for translation of the plurality of plates in directions perpendicular to the direction in which the release plate 106 is translated.

An antenna stem 117 may be positioned between the first plate 102 and the second plate 103. The first spring 104 forces the first plate 102 into engagement with the antenna stem 117. The second spring 105 forces the second plate 103 into engagement with the antenna stem 117. The first plate 102 includes a plurality of cams, including cam 126 and cam 128, to engage a cam following surface 175 of the antenna stem 117. The second plate 103 includes a plurality of cams, including cam 127 and cam 129, to engage the cam following surface 175. The cam 126 engages a portion 130 of the cam following surface 175. The cam 127 engages a portion 131 of the cam following surface 175. The cam 128 engages a portion 132 of the cam following surface 175. The cam 129 engages a portion 133 of the cam following surface 175.

The cam 126 preferably has beveled sides 164 and 165. The cam 127 preferably has beveled sides 166 and 167. The cam 128 preferably has beveled sides 168 and 169. The cam 129 preferably has beveled sides 170 and 171. Alternatively, the sides 164, 165, 166, 167, 168, 169, 170, and 171 may be curved. The bevels or curves provide a camming action that produces forces against the first spring 104 and the second spring 105. The force imparts sufficient translation of the first plate 102 toward the first side wall 118 and the second plate 103 toward the second side wall 119 to allow the antenna stem 117 to be rotated. The interaction of the cams 126, 127, 128, and 129 with the portions 130, 131, 132, and 133 of the cam following surface 175 of the antenna stem 117 against the force of the first spring 104 and the second spring 105 provides a detent action for the rotation of the antenna stem 117. Since portions 130, 131, 132, and 133 of the cam following surface 175 may be substantially equally spaced about the circumference 176 of the cam following surface 175, the detent action may be used to allow rotation of the antenna stem 117 in regular angular increments, with the antenna stem being maintained and indexed at each such increment until sufficient rotational force is applied to the antenna stem 117 to overcome the detent action.

The several portions of the cam following surface 175 may form external lands and grooves along the circumference 176 of the cam following surface 175. While portions 130, 131, 132, and 133 may be grooves, each groove may have lands adjacent to it in both directions along the circumference 176 of the cam following surface 175. For example, portion 130 may be considered to be a groove with portion 156 and portion 158 adjacent to portion 130 considered to be lands. Portion 131 may be considered to be a groove with portion 157 and portion 159 adjacent to portion 131 considered to be lands. Portion 132 may be considered to be a groove with portion 160 and portion 162 considered to be lands. Portion 133 may be considered to be a groove with portion 161 and portion 163 considered to be lands.

Projections 124 and 125 are coupled to or incorporated in a release plate 106. While the majority of the release plate is disposed in a second plane 173, the projections 124 and 125 extend into the first plane 172 in which the first plate 102 and the second plate 103 lie. The projection 124 includes a wedge surface 136 and a wedge surface 137. The wedge surface 136 engages a wedge following surface 138 of the first plate 102, and the wedge surface 137 engages a wedge following surface 139 of the second plate 103.

The projection 125 includes a wedge surface 140 and a wedge surface 141. The wedge surface 140 engages a wedge following surface 142 of the first plate 102, and the wedge surface 141 engages a wedge following surface 143 of the second plate 103. The projection 125 also includes a cam 134 that engages a portion 135 of the cam following surface 175 of the antenna stem 117. The cam 134 preferably has beveled sides 182 and 183. Alternatively, the sides 182 and 183 may be curved. The bevels or curves provide a camming action that produces forces against the wedge following surfaces 142 and 143 of the first plate 102 and the second plate 103, respectively. These forces result in forces against the first spring 104 and the second spring 105. The camming action imparts sufficient translation of the projection 125 away from the antenna stem 117 to allow the antenna stem 117 to be rotated. The interaction of the cam 134 with the portions 135 of the cam following surface 175 of the antenna stem 117 against the force of the first spring 104 and the second spring 105 provides a detent action for the rotation of the antenna stem 117.

The wedge surfaces 136, 137, 140, and 141 may have any suitable shape. For example, they may be straight or curved. The wedge following surfaces 138, 139, 142, and 143 may, likewise, have any suitable shape. For example, they may be straight or curved. The shapes of the wedge surfaces 136, 137, 140, and 141 preferably match the shapes of the wedge following surfaces 138, 139, 142, and 143, although non-matching shapes may alternatively be used.

The interaction of projections 124 and 125 with the first plate 102 and the second plate 103 provide a wedging action. When button 107 is depressed, the resulting translation of the release plate 106 causes movement of the projections 124 and 125 that results in the wedging action forcing first plate 102 apart from second plate 103 in directions toward first side wall 118 and second side wall 119, respectively. As the first plate 102 and the second plate 103 are forced apart, they are disengaged from the antenna stem 117, allowing the antenna stem 117 to be removed from the antenna indexing and retaining mechanism 100.

Figure 6:
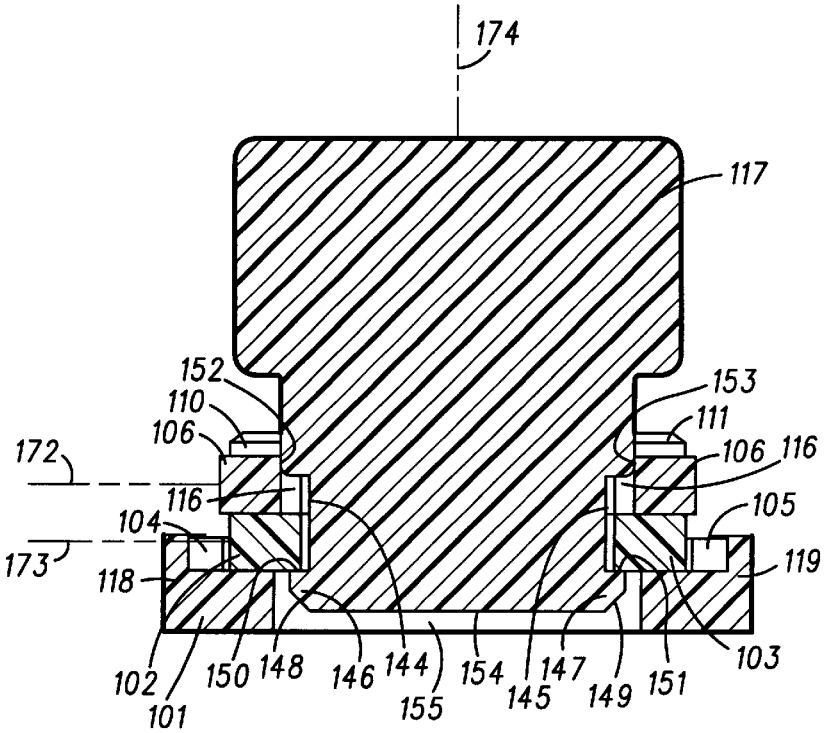
FIG. 6 is a cross-sectional view of an antenna indexing and retaining mechanism 100 in accordance with another embodiment of the invention.

FIG. 6 is a cross-sectional view of an antenna indexing and retaining mechanism 100 in accordance with another embodiment of the invention. A base plate 101 includes a first side wall 118 and a second side wall 119. A first spring 104 is disposed between the first side wall 118 and a first plate 102. A second spring 105 is disposed between the second side wall 119 and a second plate 103. An antenna stem 117 is retained between the first plate 102 and the second plate 103. An annular groove is refined on the antenna stem 117. The annular groove has a cam following surface 175 including a first antenna stem surface 144 and a second antenna stem surface 145. The first plate 102 engages the first antenna stem surface 144, and the second plate 103 engages the second antenna stem surface 145. An annular ridge 146, 147 is defined on the antenna stem 117. The annular ridge has ledges 150 and 151 to engage the first plate 102 and the second plate 103, respectively. The ledges 150 and 151 are preferably square to maintain engagement with the first plate 102 and the second plate 103, respectively, against thrust force along axis 174 and pivoting forces about the intersections of the ledges 150 and 151 and the first plate 102 and second plate 103, respectively.

The annular ridge 146, 147 includes a chamfered edge 148, 149 to cause a wedging action against the first plate 102 and the second plate 103, respectively, to allow insertion of the antenna stem 117 into the antenna indexing and retaining mechanism 100 without the need to depress button 107. The antenna stem 117 includes an end 154. The end 154 may be solid or hollow. The end 154 may include an electrical connector, for example, a coaxial connector, to mate with an electrical connector on a transceiver to which the base plate 101 is mounted. The electrical connectors may mate through an opening 155 defined in the base plate 101.

While the first plate 102 and the second plate 103 intersect a first plane 173, a release plate 106 intersects a second plane 172. The release plate defines a aperture 116 through which the antenna stem 117 may pass. The antenna stem 117 preferably includes an annular shoulder 152, 153 of increased diameter relative to the annular groove that includes antenna stem surfaces 144 and 145. The increased diameter of the annular shoulder 152, 153 closely fits within aperture 116 to allow contact between the annular shoulder 152, 153 and the release plate 106. The close fit of annular shoulder 152, 153 to release plate 106 serves to further protect the antenna stem 117 and the antenna indexing and retaining mechanism 100 from lateral force relative to axis 174. The release plate 106 and the first plate 102 are retained by an enlarged head 110 of pin 180. The release plate 106 and the second plate 103 are retained by an enlarged head 111 of pin 181. The enlarged heads 110 and 111 of pins 180 and 181 serve to protect the antenna stem 117 and the antenna indexing and retaining mechanism 100 from thrust force relative to axis 174.

Figure 7:
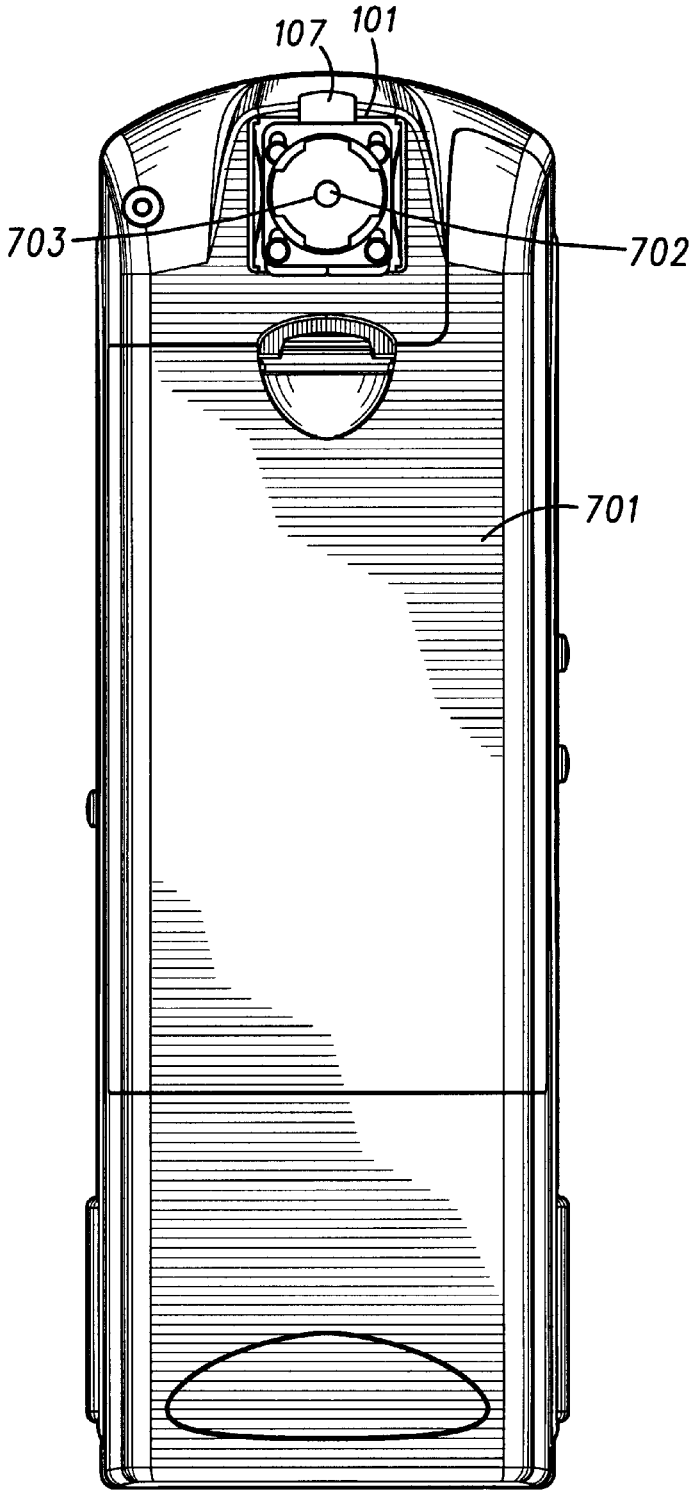
FIG. 7 is a plan view of a transceiver 701 incorporating an antenna indexing and retaining mechanism 100 in accordance with an embodiment of the invention.

FIG. 7 is a plan view of a transceiver 701 incorporating an antenna indexing and retaining mechanism 100 in accordance with an embodiment of the invention. The antenna indexing and retaining mechanism 100 is mounted with aperture 116 clear to allow insertion of an antenna stem 117. The antenna indexing and retaining mechanism 100 is mounted to allow access to the button 107 to allow release of the antenna stem 117 from the antenna indexing and retaining mechanism 100. Base plate 101 coupled to the transceiver to mount the antenna indexing and retaining mechanism 100 to the transceiver 701. Although transceiver 701 is referred to as a transceiver, it is understood that the invention may be employed in conjunction with communication equipment capable of receiving and/or transmitting communication signals, for example, receivers, transmitters, and/or transceivers. The transceiver 701 preferably includes an electrical connector, such as a coaxial connector having a center conductor 702 and a shield conductor 703. Alternatively, a non-coaxial connector may be used or the antenna indexing and retaining mechanism 100 may be constructed of conductive materials and used as both a mechanical and electrical connector.

Figure 8:
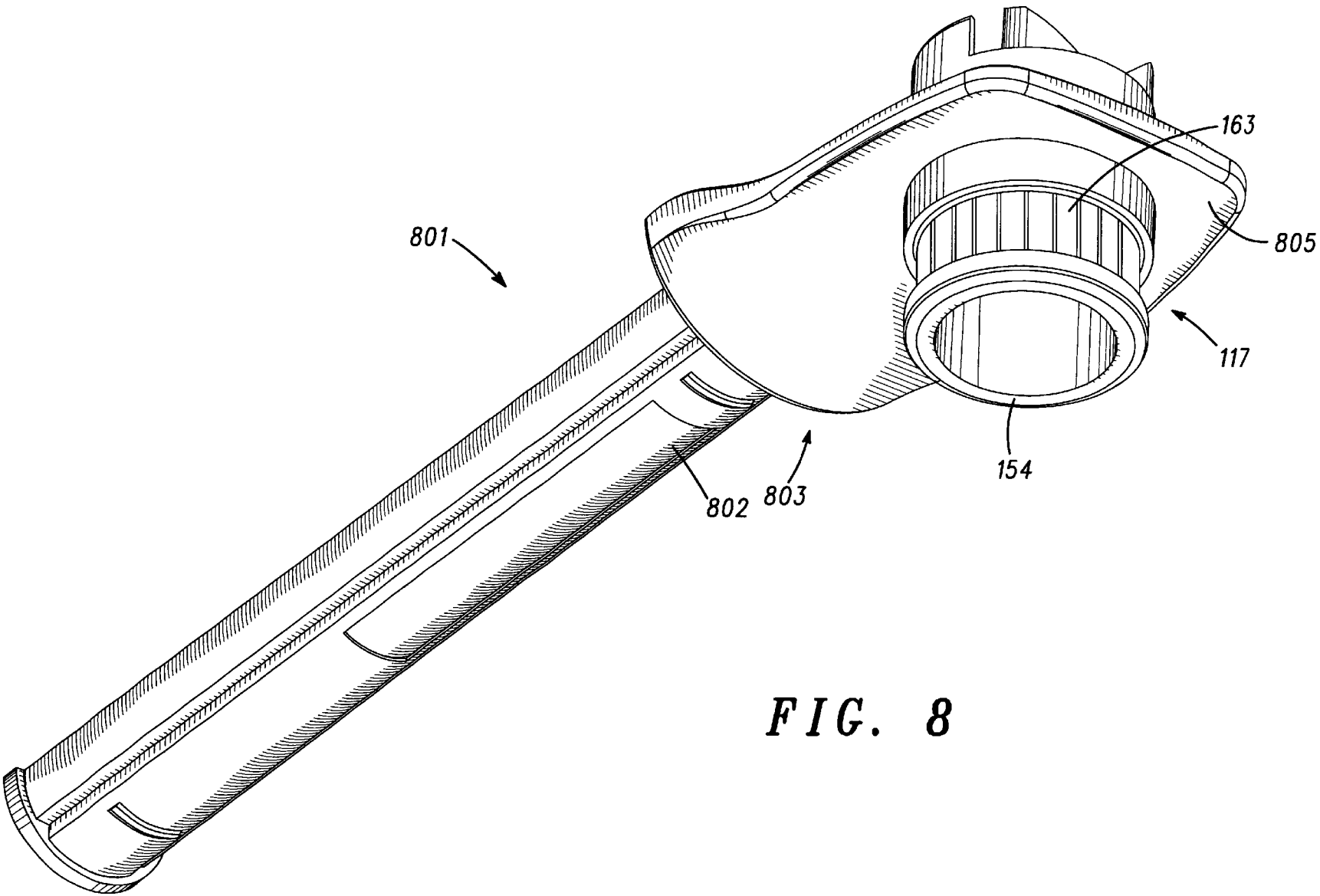
FIG. 8 is a perspective view of an antenna assembly 801 incorporating an antenna stem 117 in accordance with an embodiment of the invention.

FIG. 8 is a perspective view of an antenna assembly 801 incorporating an antenna stem 117 in accordance with an embodiment of the invention. The antenna assembly 801 includes an antenna 802, a head 803 having a side 805, and an antenna stem 117. Although the antenna 802 is illustrated as having an axis substantially perpendicular to the axis of the antenna stem 117, any suitable relationship between the antenna 802 and the antenna stem 117 is possible. An electrical connector for antenna 802 may be provided in end 154 of antenna stem 117.

Figure 9:
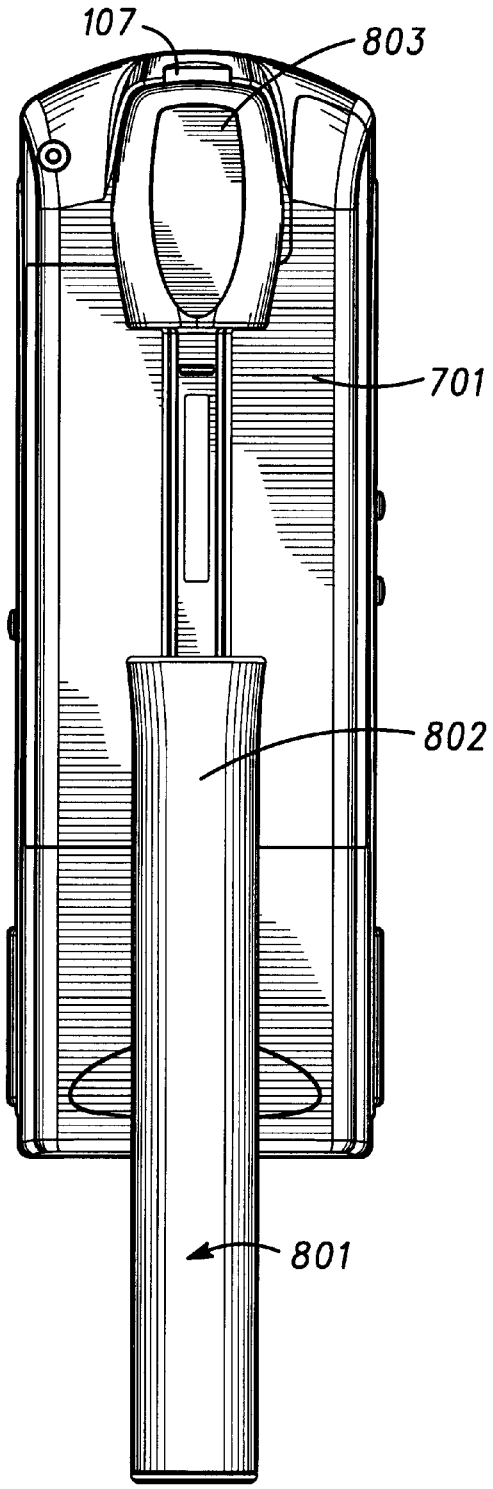
FIG. 9 is a plan view of a transceiver 701 incorporating an antenna indexing and retaining mechanism 100 with an antenna assembly 801 in a stowed position in accordance with an embodiment of the invention.

FIG. 9 is a plan view of a transceiver 701 incorporating an antenna indexing and retaining mechanism 100 with an antenna assembly 801 in a stowed position in accordance with an embodiment of the invention. The antenna 802 is oriented along a side of transceiver 701 to reduce the bulkiness of the transceiver system that includes the transceiver 701 and the antenna assembly 801. Button 107 may be used to detach the antenna assembly 801 from the transceiver 701.

Figure 10:
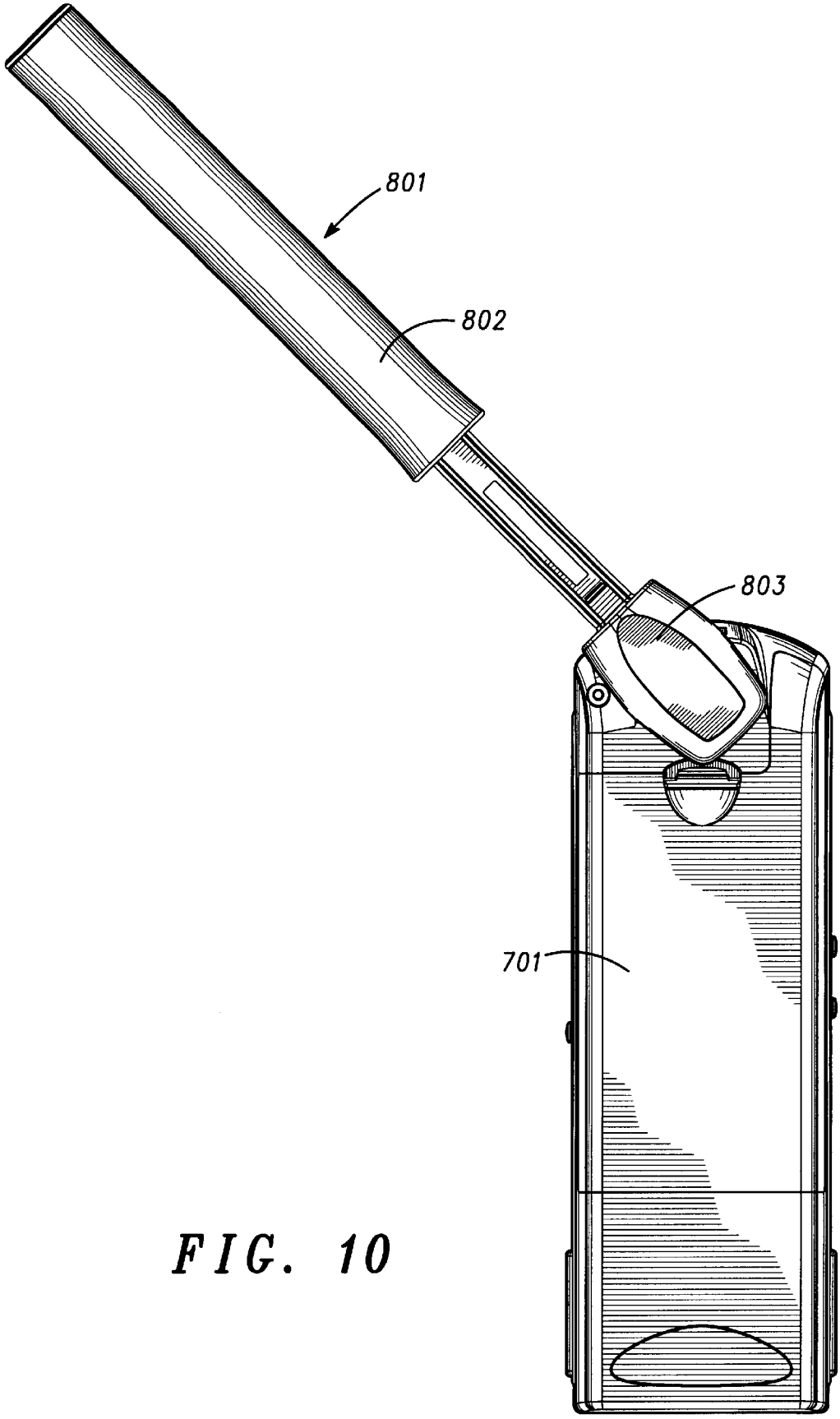
FIG. 10 is a plan view of a transceiver 701 incorporating an antenna indexing and retaining mechanism 100 with an antenna assembly 801 in a first deployed position in accordance with an embodiment of the invention.

FIG. 10 is a plan view of a transceiver 701 incorporating an antenna indexing and retaining mechanism 100 with an antenna assembly 801 in a first deployed position in accordance with an embodiment of the invention. The first deployed position would be suitable for maintaining the antenna assembly 801 in a substantially vertical position when holding the transceiver 701 to a subscriber's left ear.

Figure 11:
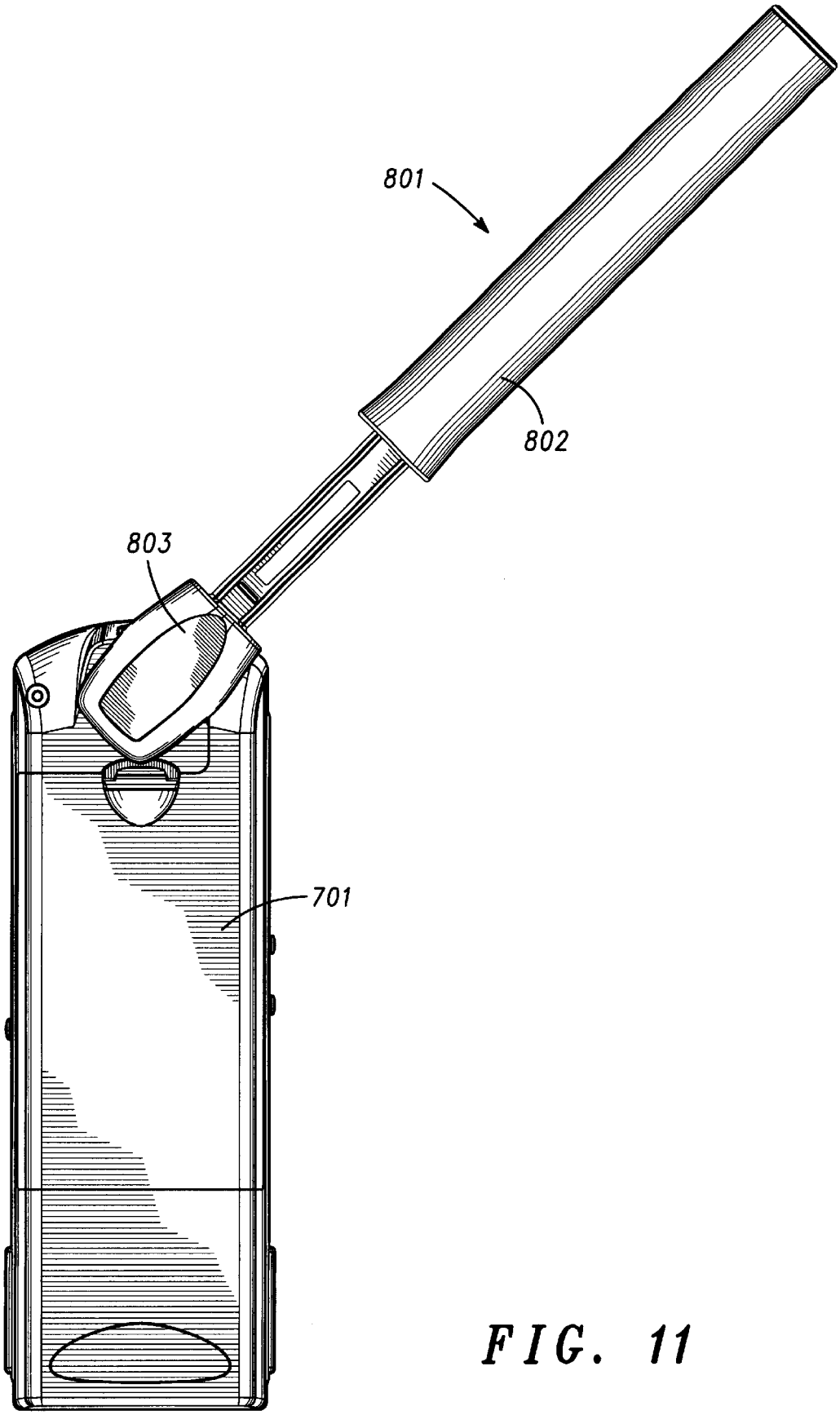
FIG. 11 is a plan view of a transceiver 701 incorporating an antenna indexing and retaining mechanism 100 with an antenna assembly 801 in a second deployed position in accordance with an embodiment of the invention.

FIG. 11 is a plan view of a transceiver 701 incorporating an antenna indexing and retaining mechanism 100 with an antenna assembly 801 in a second deployed position in accordance with an embodiment of the invention. The second deployed position would be suitable for maintaining the antenna assembly 801 in a substantially vertical position when holding the transceiver 701 to a subscriber's right ear. By virtue of the detent action provided by the antenna indexing and retaining mechanism 100, the antenna assembly 801 may be rotated in either a clockwise or counterclockwise direction between the stowed position, the first deployed position, and the second deployed position without depressing an buttons or levers and without removing the antenna assembly 801 from the transceiver 701.

The antenna indexing and retaining mechanism 100 of the present invention allows an antenna assembly 801 to be coupled to a transceiver 701 merely by pressing the antenna assembly 801 together with the transceiver, regardless of the rotational orientation of the antenna stem 117 relative to the antenna indexing and retaining mechanism 100. The antenna indexing and retaining mechanism 100 allows the antenna assembly 801 to be rotated relative to the transceiver 701 merely by applying sufficient rotational force to the antenna assembly 801, yet when the rotational force is released, the antenna assembly 801 is maintained in an indexed position relative to the transceiver 701. The antenna indexing and retaining mechanism 100 allows the antenna assembly 801 to be removed from the transceiver 701 merely by depressing button 107 and pulling the antenna assembly 801 from the transceiver 701.

Those skilled in the art will recognize that various modifications and variations can be made in the apparatus of the present invention and in construction of this apparatus without departing from the scope or spirit of this invention.

It should be understood that the implementation of other variations and modifications of the invention in its various aspects will be apparent to those of ordinary skill in the art, and that the invention is not limited by the specific embodiments described. It is therefore contemplated to cover by the present invention, any and all modifications, variations, or equivalents that fall within the spirit and scope of the basic underlying principles disclosed and claimed herein.

What is claimed is:

1. An antenna indexing and retaining mechanism for coupling an antenna stem to a transceiver, the mechanism comprising:

a plurality of plates disposed in a first plane substantially perpendicular to an axis of the antenna stem, a first plate of the plurality of plates to engage a first antenna stem surface of the antenna stem and a second plate of the plurality of plates to engage a second antenna stem surface of the antenna stem; and a release plate having projections extending into the first plane, the projections causing the plurality of plates to be disengaged from the antenna stem upon translation of the release plate.

2. The antenna indexing and retaining mechanism of claim 1 wherein the first plate comprises a first cam to engage a first portion of a cam following surface defined on the antenna stem.

3. The antenna indexing and retaining mechanism of claim 2 wherein the first cam has a beveled side.

4. The antenna indexing and retaining mechanism of claim 2 wherein the second plate comprises a second cam to engage a second portion of the cam following surface.

5. The antenna indexing and retaining mechanism of claim 4 wherein the first plate comprises a third cam to engage a third portion of the cam following surface.

6. The antenna indexing and retaining mechanism of claim 5 wherein the second plate comprises a fourth cam to engage a fourth portion of the cam following surface.

7. The antenna indexing and retaining mechanism of claim 6 wherein the first portion of the cam following surface, the second portion of the cam following surface, the third portion of the cam following surface, and the fourth portion of the cam following surface are substantially equally spaced about a circumference of the cam following surface.

8. The antenna indexing and retaining mechanism of claim 1 wherein the release plate is disposed in a second plane substantially parallel to the first plane.

9. The antenna indexing and retaining mechanism of claim 8 further comprising:

a plurality of pins extending through a first plurality of holes defined in the plurality of plates and through a second plurality of holes defined in the release plate, the pins maintaining registration of the plurality of plates and the release plate.

10. The antenna indexing and retaining mechanism of claim 9 wherein the second plurality of holes is elongated to allow movement of the release plate relative to the plurality of pins.

11. The antenna indexing and retaining mechanism of claim 10 wherein the first plurality of holes is elongated to allow movement of the plurality of plates relative to the plurality of pins.

12. The antenna indexing and retaining mechanism of claim 11 wherein the first plurality of holes is elongated in a first direction substantially perpendicular to a second direction in which the second plurality of holes is elongated.

13. The antenna indexing and retaining mechanism of claim 11 wherein the release plate defines an aperture through which the antenna stem may be placed.

14. The antenna indexing and retaining mechanism of claim 13 wherein the aperture is elongated to allow movement of the release plate relative to the antenna stem.

15. The antenna indexing and retaining mechanism of claim 14 further comprising a first spring disposed adjacent to the first plate to provide force against the first plate.

16. The antenna indexing and retaining mechanism of claim 15 further comprising a second spring disposed adjacent to the second plate to provide force against the second plate.

17. The antenna indexing and retaining mechanism of claim 16 further comprising a base plate, the base plate coupled to the plurality of pins.

18. A transceiver having an antenna assembly with an antenna stem and an antenna indexing and retaining mechanism, wherein the antenna indexing and retaining mechanism comprises:

a plurality of plates disposed in a first plane substantially perpendicular to an axis of the antenna stem, a first plate of the plurality of plates for engaging a first antenna stem surface of the antenna stem and a second plate of the plurality of plates for engaging a second antenna stem surface of the antenna stem;

a release plate having projections extending into the first plane, the projections causing the plurality of plates to be disengaged from the antenna stem upon translation of the release plate.

19. The transceiver of claim 18 further including a receiver, the receiver electrically coupled to an antenna of the antenna assembly.

20. The transceiver of claim 19 further including a transmitter, the transmitter electrically coupled to an antenna of the antenna assembly.

* * * * *